United States Patent [19]

Freeman

[11] Patent Number: 4,735,307

[45] Date of Patent: Apr. 5, 1988

[54] PROJECTILE HOLDER WITH EXTRACTOR AND LOCKING ASSEMBLY

[75] Inventor: Ronald Freeman, Dallastown, Pa.

[73] Assignee: Harsco Corporation, Camp Hill, Pa.

[21] Appl. No.: 908,591

[22] Filed: Sep. 18, 1986

[51] Int. Cl.[4] ..... F42B 37/00

[52] U.S. Cl. ..... 206/3; 89/34; 221/87

[58] Field of Search ..... 89/34, 45; 206/3; 221/87; 211/13, 60.1

[56] References Cited

U.S. PATENT DOCUMENTS

| | | | |
|---|---|---|---|
| 482,642 | 9/1892 | Lobaugh . | |
| 502,396 | 8/1893 | Cochran . | |
| 2,722,307 | 11/1955 | Burke et al. . | |
| 3,444,780 | 5/1969 | Fusee . | |
| 4,344,528 | 8/1982 | Perisastry et al. | 206/3 |
| 4,538,724 | 9/1985 | Johnson | 206/3 |
| 4,562,765 | 1/1986 | Grünewald et al. | 89/34 |
| 4,574,684 | 3/1986 | Linge et al. | 89/34 |
| 4,598,623 | 7/1986 | Hersemeyer et al. | 89/34 |
| 4,655,668 | 4/1987 | Perisastry et al. . | |

*Primary Examiner*—Stephen Marcus
*Assistant Examiner*—Bryon Gehman
*Attorney, Agent, or Firm*—Kerkam, Stowell, Kondracki & Clarke

[57] ABSTRACT

A projectile holder uses assemblies which provide projectile locking and projectile extracting. Each assembly has a control rod with a pivotably mounted spring-biased extractor member mounted thereon for extracting a projectile. The control rod, which is spring-biased backwardly, operates a cam and a locking shoe to clampingly secure a projectile within the holder. The holder allows both front and rear loading of a projectile.

23 Claims, 5 Drawing Sheets

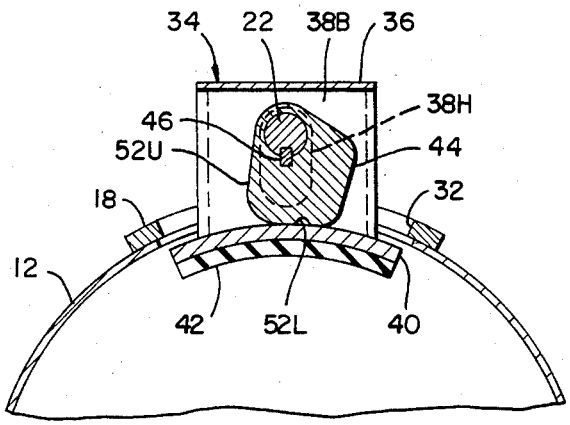
FIG 6
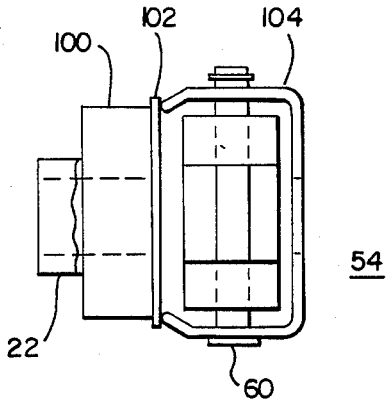
FIG 7
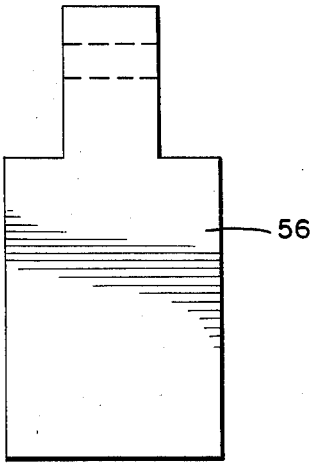
FIG 9
FIG 8
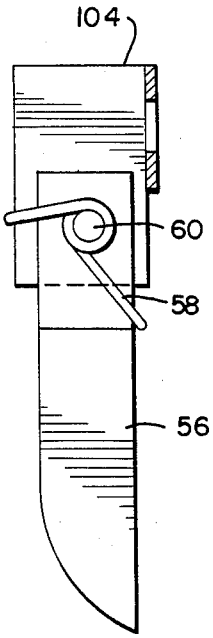

PROJECTILE HOLDER WITH EXTRACTOR AND LOCKING ASSEMBLY

BACKGROUND OF THE INVENTION

This invention relates generally to racks used for the storage and transportation of projectiles. More specifically, this invention relates to a projectile storage holder having one or more assemblies for extracting and/or locking of the projectiles.

It is essential to optimize the conveyance of projectiles in modern warfare. (As used herein, "projectiles" shall include shells, rockets, bombs, torpedoes, and, more generally, other forms of ammunition.)

Projectile storage holders must provide for a high degree of space efficiency in order to maintain a high load capacity. A projectile storage holder should allow one to easily secure and/or place one or more projectiles within the holder. At the same time, quick loading-/unloading of the projectile holder must be balanced against the need to insure that projectiles will not, accidentally or as a result of enemy fire, become dislodged from their holders.

Prior projectile storage holders include holders such as stowage rack arrays having a plurality of parallel cylindrical tubes. Such configurations have been used to store projectiles for a Self-propelled Howitzer in combination with a nose cone casting as a restraining device. In particular, the casting fits about the projectile's ogive and is secured by clamping to a stowage rack frame. Because the casting must generally match the nose of the projectile, this system is limited to accommodating only two different lengths of 155 millimeter projectiles unless one uses spacer segments.

The system using nose cone castings is disadvantageous in many respects. In order to ready the projectile for firing, the soldier or operator must unclamp the nose cone casting, stow it, and remove the projectile from the stowage rack by tactile means before performing the fusing activities. It often is difficult to remove the projectile because of the effect of steep vehicle pitch and cant angles, especially for the shorter of the two lengths of projectiles.

U.S. Pat. No. 4,344,528 of Perisastry et al., entitled "PROJECTILE LOCK ASSEMBLY", issued on Aug. 17, 1982, assigned to the assignee of the present application, and hereby incorporated by reference, shows an arrangement for radial locking of projectiles, such as 155 millimeter projectiles, into stowage racks through a cam directed pressure pad which applies tangential force onto the projectile body. This system is advantageous in that it can accommodate more than two projectile lengths. However, this system has been restricted to front loading of the projectile storage tubes. This system also allows one to advantageously fuse a projectile while it is disposed within the rack, but removal of a projectile from this rack is not as readily accomplished as desirable.

U.S. Pat. No. 4,538,724 of Johnson, issued Sept. 3, 1985, and assigned to the assignee of the present application, shows a "SPIRAL BAND LOCKING MECHANISM" which applies spring tension to hold projectiles in place. Although this design allows for different length projectiles, it is limited to front loading of the projectiles into a battlefield magazine which cooperates with the spiral band locking mechanism. Further, removal of a projectile either requires that the lock mechanism be separated from the battlefield magazine or requires one to pull a projectile completely out through the front of the mechanism.

OBJECTS AND SUMMARY OF THE INVENTION

Accordingly, it is an object of this invention to provide a new and improved projectile storage holder having an assembly for securing and/or unloading projectiles from the holder.

A more specific object of the present invention is to provide a projectile holder which may readily accommodate front and back loading of projectiles.

A further object of the invention is to provide a projectile holder which can accommodate projectiles having lengths varying over a relatively wide range.

A still further object of the present invention is to provide a projectile storage holder which allows one to perform projectile fuzing actions upon projectiles which are disposed within the holder even though the projectiles are securely restrained against movement by a vehicle in which the holders are disposed.

Another object of the present invention is to provide a projectile holder which is compact and is modular in the sense that any number of the individual holders may be grouped depending upon available space within a vehicle or room in which the holders are disposed.

Yet another object of the present invention is to provide a projectile holder having an assembly for securing and/or extracting projectiles which provides for relatively easy loading and unloading of projectiles even from a vehicle disposed with significant pitch and cant.

Yet another object of the present invention is to provide a projectile holder which allows for sufficiently quick unloading of projectiles to directly support an artillery piece, such as a self-propelled Howitzer, at a relatively high rate of fire.

The above and other objects of the present invention which will become more apparent as the description proceeds are realized by a projectile storage holder comprising a housing with at least one projectile storage zone elongated in a zone axis direction extending from a front to a back and at least one assembly for securing a projectile within the projectile storage zone, the assembly having: a control rod extending lengthwise along the zone axis direction, having a front end and a back end, and selectively rotatable into a locked position and an unlocked position; a locking surface movable by the control rod and operable to lock a projectile within the projectile storage zone when the control rod is in its locked position; and a projectile extractor mounted at the back end of the control rod and wherein the control rod is slidable frontwardly such that the projectile extractor moves frontwardly and pushes any projectile within the projectile storage zone in a frontward direction. The locking surface is preferably operable to clampingly engage a projectile such that it is locked within the projectile storage zone. The control rod rotates about a rotation axis extending in the zone axis direction. The rotation axis coincides with a central axis of the control rod and the rotation axis is parallel to the zone axis. There is a plurality of projectile storage zones and a plurality of assemblies, each of the assemblies operable to secure a projectile within an associated one of the projectile storage zones, each projectile storage zone being within an associated one of a plurality of cylindrical tubes. The projectile extractor of each assembly includes each extraction member movably attached at the back of an associated one of the control rods and biased into a first position within an associated one of the projectile storage zones. The extraction member is disposable, by contact with a projectile being inserted into the projectile storage zone from the back, into a second position allowing insertion of the projectiles. The control rod is slidable forwardly such that the extraction member, when disposed in its first position, pushes any projectile within the projectile storage zone in a frontward direction. Each extraction member is pivotably attached to the back end of one of the control rods and is biased by an associated member-biasing spring. Each control rod is biased backwardly by an associated rod-biasing spring. The assembly further includes a shoe upon which the locking surface is disposed and a camming surface cooperating with the control rod and the shoe. Rotation of the control rod to its locked position causes the camming surface to move the locking surface towards the zone axis to clampingly engage a projectile such that it is locked within the projectile storage zone.

The present invention may alternately be described as a projectile storage holder having a front and a back and comprising a housing with at least one projectile storage zone elongated in a zone axis direction and at least one assembly for securing a projectile within the projectile storage zone, the assembly having: a control rod; a locking surface movable and operable by the control rod to lock a projectile within the projectile storage zone when the control rod is in a locked position; and a member movably attached at the back of the control rod and disposable within the projectile storage zone, the member limiting the backward movement of a projectile disposed completely in front of the member within the projectile storage zone, the member movable out of the path of a projectile by contact with a projectile upon a projectile being inserted from the back of the projectile storage zone. The member is an extraction member and the control rod is slidable frontwardly such that the extraction member, when disposed in a first position relatively close to the zone axis, pushes any projectile within the projectile storage zone towards said front. The assembly further comprises a member-biasing spring biasing the extraction member into the first position and, upon a projectile being inserted into the projectile storage zone from the back, the projectile moves the extraction member into a second position away from the zone axis. The extraction member is pivotably attached at the back of the control rod and is vertically disposed in the first position and pivots frontwardly into the second position. The control rod is biased backwardly by an associated rod-biasing spring.

The present invention may alternately be described as a projectile storage holder having a front and a back and comprising at least one projectile storage zone elongated in a zone axis direction and at least one assembly having: a control rod extending lengthwise along the axial direction and having a front and a back; an extraction member movably attached at the back of the control rod and biased into a first position within the projectile storage zone, the extraction member disposable, by contact with a projectile being inserted into a projectile storage zone from the back, into a second position allowing insertion of the projectile. The control rod is slidable frontwardly such that the extraction member, when disposed in its first position, pushes any projectile within a projectile storage zone in a frontward direction. The assembly further comprises a member-biasing spring biasing the extraction member into the first position and wherein the extraction member limits backward movement of a projectile disposed completely in front of the member within the projectile storage zone. The assembly is operable for securing a projectile within the projectile storage zone. The control rod has a central axis parallel to the zone axis and is selectively rotatable about the central axis into a locked position and an unlocked position, the assembly further comprising a locking surface operable by the control rod to lock a projectile within the projectile storage zone when the control rod is in its locked position. The control rod is biased backwardly by an associated rod-biasing spring.

BRIEF DESCRIPTION OF THE DRAWINGS

The above and other features, objects, and advantages of this invention will become more apparent when the following detailed description is considered in conjunction with the accompanying drawings wherein like characters represent like parts throughout the several views and in which:

FIG. 6 shows a cross-section front view of a cam and a locking shoe as used with the present invention.

FIG. 7 shows an enlarged top view of a retainer assembly used with the present invention.

FIG. 8 shows a cross-sectional side view of a retainer assembly.

FIG. 9 shows a front view of a retainer member or bar.

DETAILED DESCRIPTION

Figure 1:
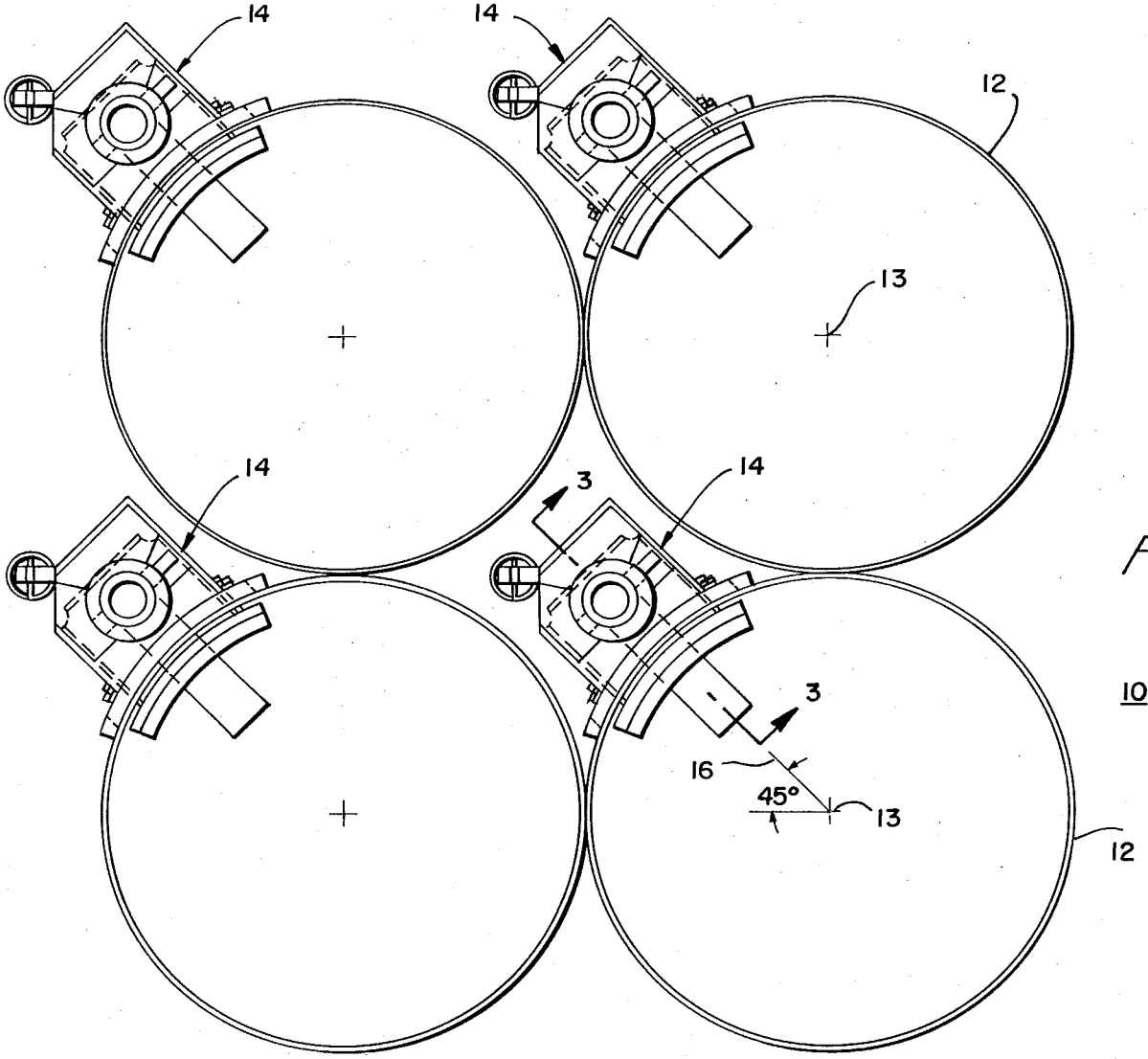
FIG. 1 shows a front view of a projectile holder according to the present invention.

The projectile storage holder 10 of the present invention, as shown by the front view of FIG. 1, inc1udes a housing with a plurality of parallel cylindrical metal tubes 12 having projectile storage zones disposed therein. Each projectile storage zone within one of the tubes 12 is centered about a zone axis 13, which is perpendicular to the plane of view of FIG. 1. Mounted upon each of the tubes 12 is an assembly 14 for securing and extracting projectiles the associated tube 12.

Although the view of FIG. 1 shows four of the tubes 12 arranged in a 2×2 matrix, the holder 10 may be constructed as a 2×5 matrix and may include structural framework outside and between the various tubes 12 as shown for the preferred embodiment in the incorporated by reference Perisastry et al. U.S. Pat. No. 4,344,528. Additionally, the unit may be designed with support posts to allow one of the holders 10 to be stacked upon another of the holders 10 in similar fashion to the holder or storage rack shown in the Perisastry patent. As the present invention is an improvement upon the design disclosed in Perisastry, the present description will concentrate upon differences between the present invention and the design of Perisastry. It will be readily understood that components which are not discussed in detail may be constructed in identical fashion to like components in the Perisastry design.

Each of the assemblies 14 is centered about a line 16 which extends at 45° to the horizontal as shown in FIG. 1. As further illustrated in FIG. 1, this placement for the assemblies 14 advantageously uses space disposed between the cylinders 12 such that the cylinders 12 may be disposed upon all sides of the assemblies 14, this being best illustrated by the assembly 14 at the lower right of FIG. 1.

Figure 2:
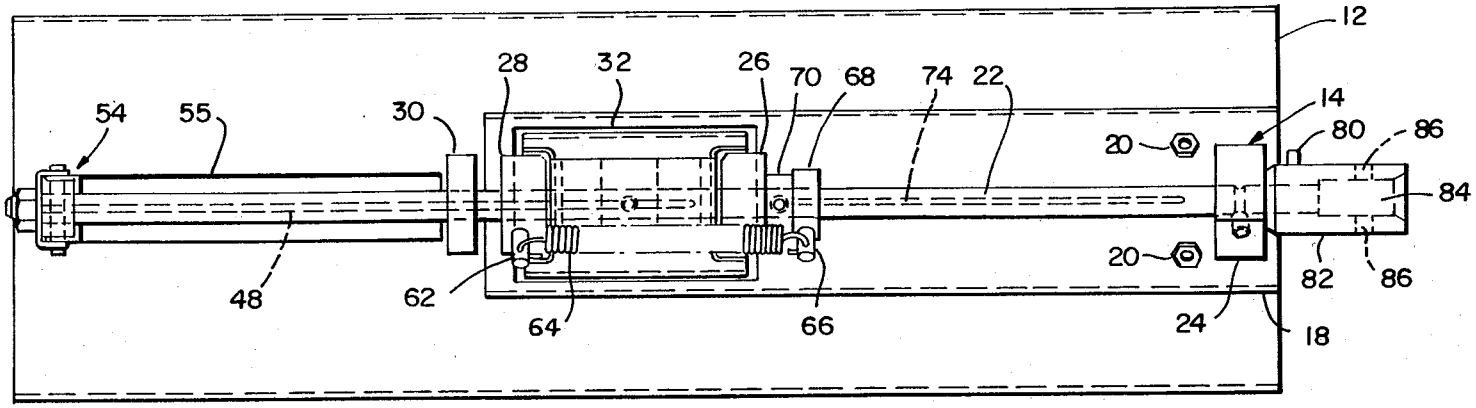
FIG. 2 shows a top (i.e., 45° from horizontal at upper left of FIG. 1) view of a locking and extracting assembly according to the present invention.

The parts of the assembly 14 wil1 be described with reference to FIG. 2 showing a view looking towards zone axis 13 along the line 16. For ease of illustration, the FIG. 2 view shows but a single tube 12 and a single associated assembly 14, but it will be readily understood that the other tubes and assemblies 14 may be identically constructed.

The assembly 14 includes a support plate 18 which is cylindrically curved to mate and seat upon a portion of the tube 12. The support plate 18 may be secured to the tube 12 by way of rivets 20.

Figure 3:
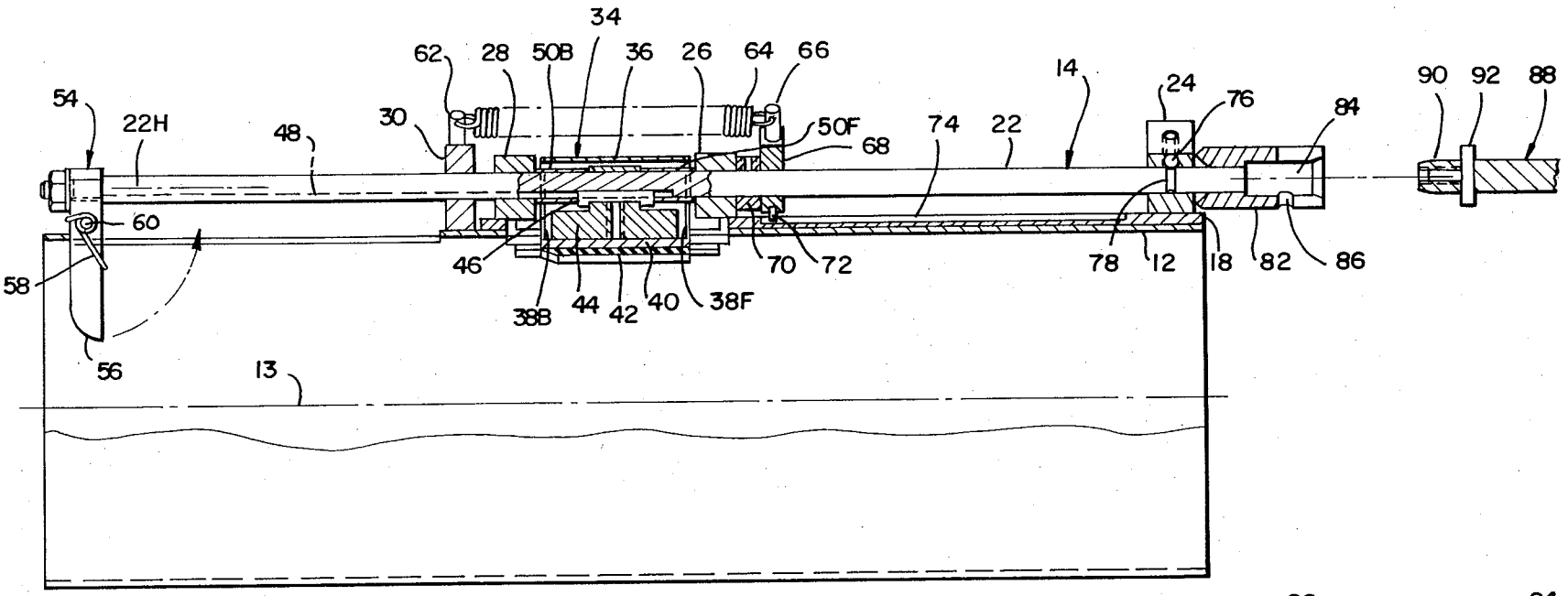
FIG. 3 shows a sectional view taken along Lines 3—3 of FIG. 1 illustrating parts of the locking and extracting assembly.

A control rod 22 extends lengthwise in parallel fashion to the tubes 12 and of course to the central zone axis 13 within the tube 12 (see FIG. 3).

With reference to FIGS. 2 and 3, the mounting of the control rod 22 will be discussed. Lugs 24, 26, and 28 are mounted upon the support plate 18 and serve to rotatably support the control rod 22. Each of the lugs 24, 26, and 28 is welded or otherwise fixed to the support plate 18. In addition to being journaled through the lugs 24, 26, and 28, the control rod 22 is rotatably mounted through a hole in lug 30 which is welded or otherwise fixed to the tube 12. Accordingly, the control rod 22 together with the rivets 20 and the various lugs maintain the cylindrical curved support plate 18 fixed to the corresponding portion of tube 12.

Disposed between lugs 26 and 28 and adapted to extend into rectangular hole 32 (which extends through support plate 18 and through the tube 12 immediately there below) is a shoe 34 including a top plate 36, front and back plates 38F and 38B respectively (see especially FIG. 3), and a cylindrical gripping plate 40 having a rubber pad 42 disposed thereon. The lower surface of the rubber pad 42 serves as a locking surface to clampingly engage projectiles within the storage zone defined by the tube 12. A cam 44 is secured to rotate with the control rod 22 by way of a floating key 46 extending into keyway 48 extending lengthwise along the control rod 22. As will be appreciated by comparing FIG. 3 and FIG. 4, the floating key 46 and keyway 48 allows the control rod 22 to move lengthwise with the cam 44 remaining stationary as key 46 "floats" in keyway 48. Thus, the rod 22 is slidable relative to cam 44 and the clamping or locking surface 42. The cam 44 is centered between the lugs 26 and 28 by way of collar-like spacers 50F and 50B.

Continuing to consider FIGS. 2 and 3, but also viewing the simplified cross-sectional view of FIG. 6, the shoe 34 includes two holes 38H (only one is visible in FIG. 6) upon the plates 38B and 38F which allow the shoe 34 to move in and out relative to the projectile storage zone within the cylinder 12. In the view of FIG. 6, the cam 44 is positioned with a locking portion 52L disposed against plate 40. The locking portion 52L is part of a camming surface also including unlocking portion 52U on cam 44. Dependent upon rotation of the control rod 22, the cam 44 may have its locking surface 52L disposed against the plate 40 causing the locking surface on the rubber pad 42 to lock a projectile within tube 12 or have its unlocking surface 52U disposed against the plate 40 in which case the gripping plate 40 and rubber pad 42 would be outwardly disposed from the position shown in FIG. 6.

Figure 4:
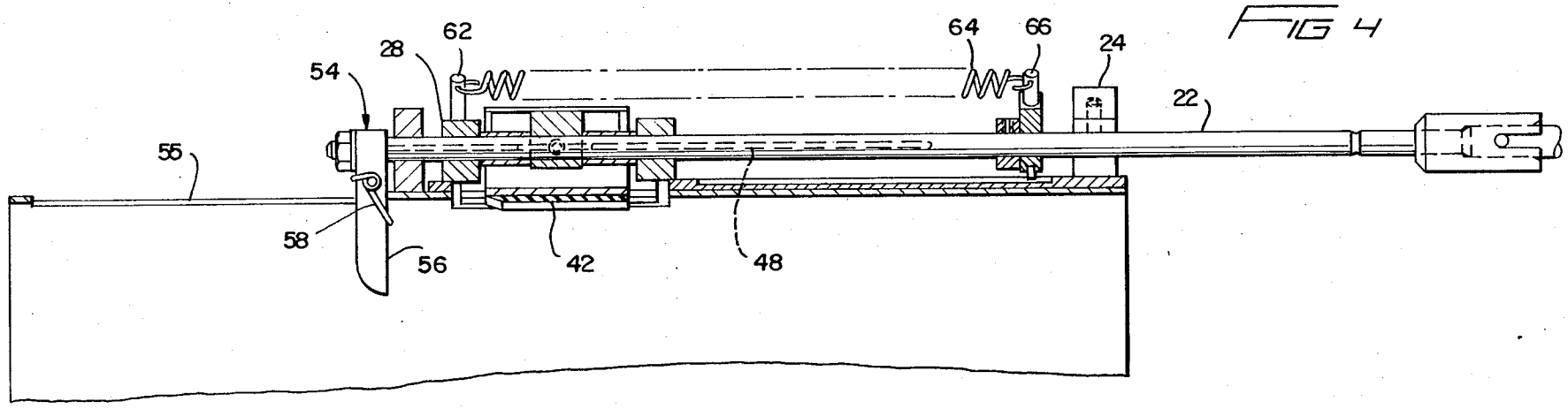
FIG. 4 shows a cross-sectional view similar to FIG. 3 with the assembly in an extracting position.

With reference now to FIGS. 2, 3, and 4, a retainer assembly 54 will be generally described. The retainer assembly 54 is mounted at the back of the control rod 22 and has an extractor member 56 biased by member-biasing spring 58 to maintain the position shown in FIG. 3 with the member 56 extending perpendicularly relative to the central axis 22H of the control rod 22 (see especially FIG. 3). The extractor member 56 is pivotably mounted upon pivot pin 60 so that it may pivot 90° counter-clockwise from the position shown in FIG. 3. Most advantageously, this allows one to readily insert a projectile into the back (i.e., side closest to retainer 54) of the cylinder 12. As shown, the back surface of extractor member 56 is curved to readily allow it to be pushed up parallel or approximately parallel to axis 22H by insertion of a projectile into the rear of the tube 12. As shown in FIGS. 3 and 4, the tube 12 is open at both its front and back ends so that projectiles may be loaded from either end.

Mounted upon the lug 30 is a pin 62 attached to a spring 64. The other end of the spring 64 is attached to a pin 66 extending from block 68. The block 68 is free to slide along rod 22 except that the spring 64 holds it securely against collar 70 which is fixed to the control rod 22 by a set screw. The block 68 has a lower pin 72 which rests within a track 74 on top of the support plate 18. As shown, the track 74 extends parallel to control rod 22 and zone axis 13. As will be discussed in detail below, the block 68 and collar 70 will move frontwardly and backwardly with the control rod 22 and with pin 72 cooperating with track 74 to maintain the pin 66 axially in line with the pin 62.

The block 24 includes a ball detent plunger 76 which cooperates with a depression 78 extending around the control rod 22 such that the control rod 22 will resist movement out of its position shown in FIG. 3.

Figure 5:
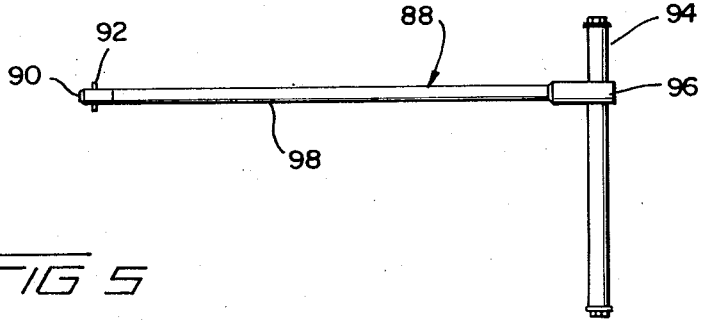
FIG. 5 shows a tool useful for operating the locking and extracting assembly.

The control rod 22 includes a pointer pin 80 (FIG. 2 only) mounted upon rod end 82. The rod end 82 is shaped as shown in FIGS. 2 and 3 including a generally cylindrical cavity 84 and holes 86 in order to accommodate a tool 88 (shown partially in cross-section in FIG. 3 and shown completely in FIG. 5). The tool includes a portion 90 adapted to fit within cavity 84 with pin 92 extending through holes 86 so as to allow the tool 88 to mate with rod end 82. The mating between portions 90 and pin 92 and rod end 82 allows tool 88 to maintain contact with the control rod during rotation in clockwise and counter-clockwise directions and during longitudinal displacement. The tool 88 includes a floating handle 94 extending through tube 96 attached at the end of shaft 98 of the tool.

With reference now to FIGS. 7, 8, and 9, a particular construction for the retainer assembly 54 will be discussed. For ease of illustration, the control rod 22 is shown only partially at the left side of FIG. 7 and the spring 58 has been deleted from the view of FIG. 7. The control rod 22 includes a nut 100 holding washer 102 and pivot mount 104 to the back end of the control rod 22. The extractor member 56 is mounted upon the bottom of pivot mount 104 by pivot pin 60. The spring 58 biases the extractor 56 to the position shown in FIG. 8 and it is unable to rotate further clockwise by virtue of contact between retainer 56 and a portion of pivot mount 104. However, the retainer 56 can move approximately 90° in counter-clockwise direction upon insertion of a projectile from the back (i.e., the left side of FIG. 8). As will be readily appreciated, the member 56 could be biased into its first position (FIG. 3 position) by the weight of the member or by forces other than a force from a spring.

OPERATION

The assembly 14 would normally have the control rod 22 disposed in its backward position shown in FIG. 2. A projectile may be loaded from the front side of tube 12 (adjacent rod end 82) and slid backwards in the projectile storage zone within tube 12 until it hits the retainer assembly 54 and, more specifically, the extractor member 56. The extractor member 56 prevents the projectile loaded from the front from passing out the open back end of tube 12. (As an added safety feature, the projectile storage holders 10 would often be disposed within a vehicle having a bustle door immediately behind the extractor member 56 such that, in the unlikely event that the extractor member 56 does not limit backward movement of the projectile, the closed bustle door would do so.) During insertion of the projectile (not shown), the control rod 22 would be rotatably disposed such that its unlocking surface 52U (FIG. 6) would be against the outside of plate 40. The projectile would freely slide underneath the locking surface of rubber pad 42. Upon the projectile being disposed with the tube 12, the tool 88 is secured to rod end 82 and the control rod 22 is rotated 130° such that locking surface 52L (FIG. 6) would be disposed against gripping plate 40, thereby clampingly securing the projectile against the inner surface of rubber pad 42. The nose of the projectile may still extend forwardly from the tube 12 so as to allow fuzing of the projectile while it is locked in holder 10. The pointer 80 (FIG. 2 only) may point to indicia (not shown) upon the front face of block 24 to indicate whether the control rod is locked or unlocked in the same fashion as with the design of the Perisastry patent.

When it is desired to remove a projectile from the tube 12, the tool 88 is used to rotate the control rod 22 back to an unlocked position. The tool 88 may then be pulled frontwardly and away from tube 12 such that the control rod 22 moves forward to the position shown in FIG. 4 with the extractor member 56 proceeding along hole 55 in the tube 12. The extractor 56 pushes the projectile frontwardly so as to allow easy removal of the projectile from the tube 12. The tool 88 applies sufficient forward force to the control rod 22 to overcome the ball detent 76 and to pull against the bias of the rod-biasing spring 64. Upon removal of the tool 88 from the control rod tip 82, the spring 64 would pull the control rod 22 back to its FIG. 3 position.

When it is desired to insert a projectile from the rear of tube 12, the control rod 22 would of course be in its unlocked position. The projectile would then be inserted nose first into the back of tube 12. As the projectile proceeded frontwardly in the tube 12, the extractor member 56 would rotate counter-clockwise (view of FIG. 3) so as to allow passage of the projectile thereunder. The ball detent 76 and spring 64 prevent the control rod 22 from moving forwardly. Upon the projectile being sufficiently forward to clear the extractor member 56, the member 56 would snap back to its position shown in FIG. 3. The projectile may then be moved backwardly to seat against the front surface of member 56. The tool 88 may then be used to rotate control rod 22 and lock the projectile in place.

Although various specific constructions have been described herein, it is to be understood that these are for illustrative purposes only. Various modifications and adaptations will be readily apparent to those of skill in the art. Accordingly, the scope of the present invention should be determined by reference to the claims appended hereto.

What is claimed is:

1. A projectile storage holder comprising a housing with at least one projectile storage zone elongated in a zone axis direction extending from a front to a back and at least one assembly for securing a projectile within said projectile storage zone, said assembly having:

a control rod extending lengthwise along said zone axis direction, having a front end and a back end, and selectively rotatable into a locked position and an unlocked position;

a locking surface moveable by said control rod and operable to lock a projectile within said projectile storage zone when said control rod is in its locked position; and a projectile extractor mounted at said back end of said control rod and wherein said control rod is slidable frontwardly such that said projectile extractor moves frontwardly and pushes any projectile within said projectile storage zone in a frontward direction such that the projectile is removable from the front of the projectile storage zone.

2. The projectile storage holder of claim 1 wherein said locking surface is operable to clampingly engage a projectile such that it is locked within said projectile storage zone.

3. The projectile storage holder of claim 2 wherein said control rod rotates about a rotation axis extending in said zone axis direction.

4. The projectile storage holder of claim 3 wherein said rotation axis coincides with a central axis of said control rod, and said rotation axis is parallel to said zone axis.

5. The projectile storage holder of claim 4 wherein said housing has a plurality of projectile storage zones and including a plurality of assemblies, each of said assemblies operable to secure a projectile within an associated one of said projectile storage zones, each projectile storage zone being within an storage zone being within an associated one of a plurality of cylindrical tubes.

6. The projectile storage holder of claim 5 wherein said projectile extractor of each assembly includes an extraction member movably mounted at the back end of an associated one of said control rods and biased into a first position within an associated one of said projectile storage zones, said extraction member disposable, by contact with a projectile being inserted into a projectile storage zone from the back, into a second position allowing insertion of the projectile.

7. The projectile storage holder of claim 6 wherein each extraction member is pivotably attached to the back end of one of said control rods and is biased by an associated member-biasing spring.

8. The projectile storage holder of claim 7 wherein each control rod is biased backwardly by an associated rod-biasing spring.

9. The projectile storage holder of claim 1 wherein said control rod is biased backwardly by an associated rod-biasing spring.

10. The projectile storage holder of claim 9 wherein said assembly further has a shoe upon which said locking surface is disposed and a camming surface cooperating with said control rod and said shoe, and wherein rotation of said control rod to its locked position causes said camming surface to move said locking surface towards said zone axis to clampingly engage a projectile such that it is locked within said projectile storage zone.

11. The projectile storage holder of claim 1 wherein said control rod is slidable relative to said locking surface.

12. A projectile storage holder comprising a housing with at least one projectile storage zone elongated in a zone axis direction extending from a front to a back and at least one assembly for securing a projectile within said projectile storage zone, said assembly having:

a control rod extending lengthwise along said zone axis direction, having a front end and a back end, rotatable into a locked position and an unlocked position;

a locking surface movable by said control rod and operable to lock a projectile within said projectile storage zone when said control rod is in its locked position;

a member movably attached at the back of said control rod and disposable within said projectile storage zone, said member limiting the backward movement of a projectile disposed completely in front of said member within said projectile storage zone, said member movable out of the path of a projectile by contact with a projectile upon a projectile being inserted from the back of said projectile storage zone, and wherein said member is an extraction member and said control rod is slidable frontwardly such that said extraction member, when disposed in a first position relatively close to said zone axis, pushes any projectile within said projectile storage zone towards said front.

13. The projectile storage holder of claim 12 further comprising a member-biasing spring biasing said extraction member into said first position and, upon a projectile being inserted into said projectile storage zone from the back, the projectile moves said extraction member into a second position away from said zone axis.

14. The projectile storage holder of claim 13 wherein said extraction member is pivotably attached to the back of said control rod and is vertically disposed in said first position and pivots frontwardly into said second position.

15. The projectile storage holder of claim 12 wherein said control rod is biased backwardly by an associated rod-biasing spring.

16. The projectile storage holder of claim 12 wherein said extraction member is operable to allow removal of a projectile from the front of the projectile storage zone.

17. The projectile storage zone of claim 12 wherein said control rod is slidable relative to said locking surface.

18. A projectile storage holder comprising at least one projectile storage zone elongated in a zone axis direction extending from a front to a back and at least one assembly having:

a control rod extending lengthwise along said zone axis direction and having a front and a back;

an extraction member movably attached to the back of said control rod and biased into a first position within said projectile storage zone, said extraction member disposable, by contact with a projectile being inserted into a projectile storage zone from the back, into a second position allowing insertion of the projectile; and wherein said control rod is slidable frontwardly such that said extraction member, when disposed in its first position, pushes any projectile within said projectile storage zone in a frontward direction such that the projectile is removable from the front of said projectile storage zone.

19. A projectile storage holder of claim 18 wherein said extraction member is pivotably attached at the back of said control rod and is vertically disposed in said first position and pivots frontwardly into said second position.

20. A projectile storage holder of claim 18 further comprises a member-biasing spring biasing said extraction member into said first position and wherein said extraction member limits backward movement of a projectile disposed completely in front of said member within said projectile storage zone.

21. A projectile storage holder of claim 18 wherein said assembly is operable for securing a projectile within said projectile storage zone, said control rod has a central axis parallel to said zone axis and is selectively rotatable about said central axis into a locked position and an unlocked position, said assembly further comprising a locking surface movable by said control rod and operable to lock a projectile within said projectile storage zone when said control rod is in its locked position; and wherein said holder includes a plurality of projectile storage zones and a plurality of assemblies, each of said assemblies operable to secure a projectile within an associated one of said projectile storage zones, each projectile storage zone being within an associated one of a plurality of cylindrical tubes.

22. A projectile storage holder of claim 18 wherein said control rod is biased backwardly by an associated rod-biasing spring.

23. The projectile storage holder of claim 18 wherein said control rod is slidable relative to said locking surface.

* * * * *